US005119348A

United States Patent [19]

Mathys

[11] Patent Number: 5,119,348

[45] Date of Patent: Jun. 2, 1992

[54] MECHANICAL SELFWINDING WATCH MOVEMENT

[75] Inventor: Pierre Mathys, La Chaux-de-Fonds, Switzerland

[73] Assignee: Frederic Piguet S.A., Le Brassus, Switzerland

[21] Appl. No.: 523,419

[22] Filed: May 15, 1990

[30] Foreign Application Priority Data

Jun. 1, 1989 [CH] Switzerland ..... 02065/89

[51] Int. Cl.[5] ..... G04B 5/00

[52] U.S. Cl. ..... 368/151; 368/148

[58] Field of Search ..... 368/148, 151, 152, 207-212

[56] References Cited

U.S. PATENT DOCUMENTS 1,799,454 4/1931 Burke ..... 368/140
2,724,234 11/1955 Meyer ..... 368/140
2,928,231 5/1960 Murrle ..... 368/140
4,363,553 12/1982 Thomi et al. ..... 368/140

FOREIGN PATENT DOCUMENTS 2341886 9/1977 France .
357335 11/1961 Switzerland .

*Primary Examiner*—Bernard Roskoski
*Attorney, Agent, or Firm*—Young & Thompson

[57] ABSTRACT

In the mechanical selfwinding watch movement with an oscillating winding weight, the winding weight and the spring barrel driving the movement are pivoted coaxially, in the center of the movement, above the winding and the movement gears. The winding weight and the spring barrel have substantially the same thickness and they are on the same level. The spring barrel occupies almost the whole space in the path of the heavy sector of the winding weight. Due to the permissible size of such a spring barrel, the latter is able to store up an energy sufficient to keep the movement running during eight days at least.

9 Claims, 2 Drawing Sheets

MECHANICAL SELFWINDING WATCH MOVEMENT

BACKGROUND OF THE INVENTION

1. Field of the Invention

This invention relates to the mechanical selfwinding watch movements, particularly to those wound up by means of a winding weight oscillating under accelerations due to gravity and to the displacements of the watch movement.

2. Prior Art

Numerous watch movements with a duration of run of more than 72 hours and preferably of a duration of run ranging up to eight days are known in the art. However, none is provided with a selfwinding mechanism. An important drawback of the known movements wound up manually consists in the fact that the watch carrier does not remember the days requiring a winding up: either he winds up the movement too often, when it is not necessary, or he forgets to wind it up and the watch stops running at moments which can be very inopportune.

SUMMARY OF THE INVENTION

The invention aims to create a mechanical selfwinding watch movement, the duration of run of which is more than 72 hours and preferably ranges up to eight days when it is fully wound up.

For this purpose, the spring barrel is mounted within the winding weight, coaxially thereto, in the center of the watch movement. The size which this arrangement permits one to give to the barrel, enables locating therein a spring with a great number of windings, which is capable of driving the movement during eight days at least while ensuring to provide a torque which is sufficient and constant during almost all the time of its unwinding. The watch equipped with such a movement can, for instance, only be carried on Sunday and then be wound up enough to remain running until the next Sunday.

BRIEF DESCRIPTION OF THE DRAWINGS

One embodiment of the watch movement according to the invention is represented diagrammatically and only by way of example in the accompanying drawings.

In the drawings.

DESCRIPTION OF THE PREFERRED EMBODIMENT

Figure 1:
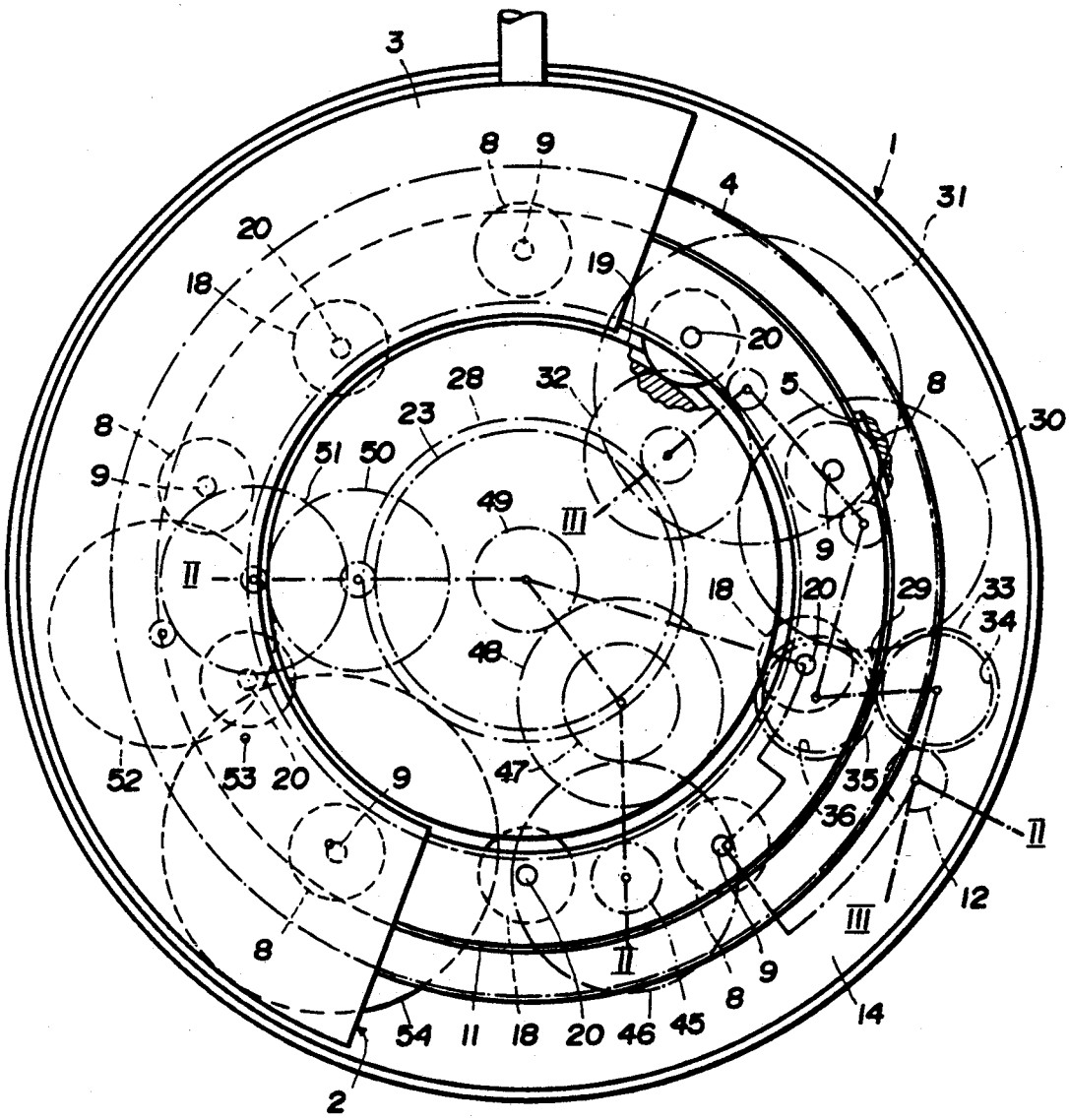
FIG. 1 is a plan view of that embodiment with two small parts cut away.

The automatic winding up of the movement 1 is ensured by an oscillating winding weight 2. This winding weight is composed of a halfcircular heavy crown sector 3, which is fixed to a ring 4. The latter is provided with a peripheral groove 5 in its inner face having a rectangular cross-section, and with a toothing 6 formed in an outer lower rim 7. The weight 2 is rotatably mounted coaxially to the movement 1 by means of five rollers with ball bearings 8. The outer periphery of rollers 8 engages in groove 5 of ring 4, whereas the center is fixed to a pin 9, the ends of which are fitted in fixed lower 10 and upper 11 rings. As regards toothing

6, it meshes with a pinion 12 overhung pivoted in a ball bearing 13, the outer running race of which is set with force fit into a bore of the base plate 14 of movement 1.

Figure 2:
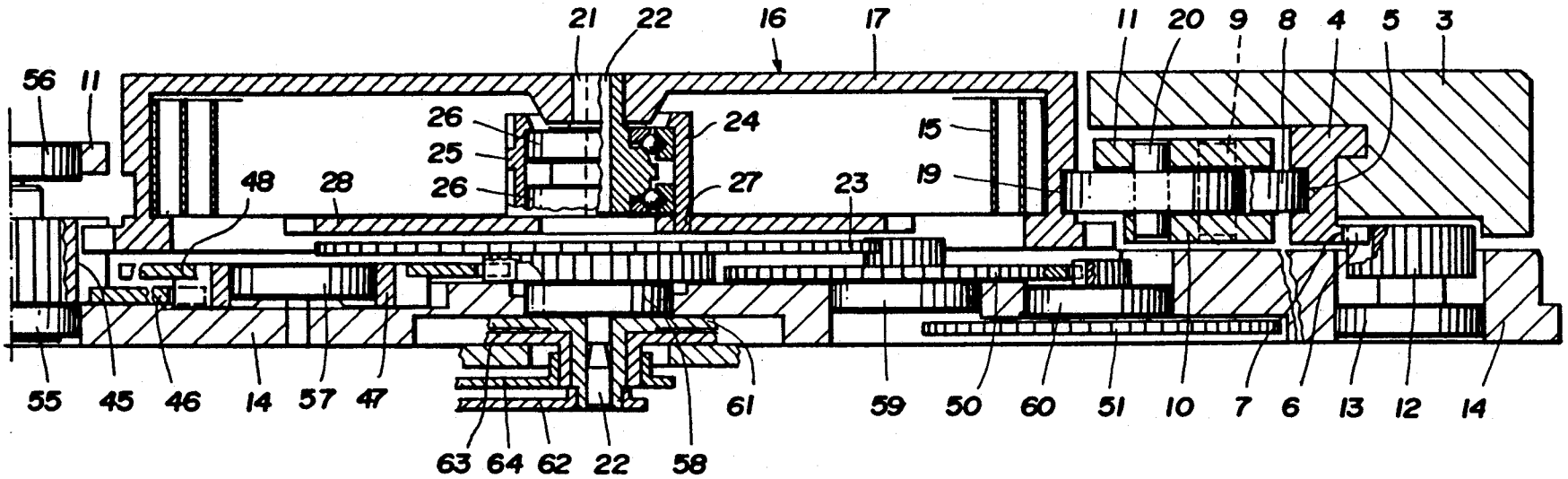
FIG. 2 is a sectional view on a larger scale along lines II—II—II of FIG. 1.

By rotating in one and the other direction, the weight 2 winds up a spring 15 in barrel 16. The latter is located in winding weight 2. It occupies almost the whole free space in the path, along which the sector 3 of the weight moves. FIG. 2 shows that the barrel 16 and the weight 2 substantially have the same thickness and that their upper and lower faces are approximately on the same level.

The body 17 of barrel 16 is rotatably mounted coaxially to weight 2 by means of five rollers with ball bearings 18. For this purpose, the outer face of the side wall of body 17 is provided with a peripheral groove 19, having a rectangular cross-section and in which the outer peripheries of rollers 18 enter. Like with rollers 8, the centers of rollers 18 are fixed to pins 20, the ends of which are force fitted into rings 10, 11. FIG. 1 shows that every pin 20 is set in rings 10, 11 at the same distance from adjacent pins 9 of rollers 8. The rings 10, 11 are fixed to the base plate 14 in a manner not shown, well known to those skilled in the art. FIG. 2 shows that these rings do not at all increase the thickness of movement 1.

The central opening of body 17 of barrel 16 is set with force fit onto the end of a sleeve 21, the central bore 22 of which permits holding the arbor of the center wheel 23, when setting the hands. The mid core of barrel 16 is constituted by a simple sleeve 24 on which the ancorage hook 25 of the spring 15 is formed. The outer peripheries of two rollers 26 with ball bearings are set with force fit into sleeve 24, whereas the centers of rollers 26 are fixed to sleeve 21. At the bottom, the sleeve 24 is provided with two projections 27 which are set into corresponding cutouts of ratchet wheel 28 and fixed to the latter in order to solidarize the ratchet wheel 28 to sleeve 24.

Figure 3:
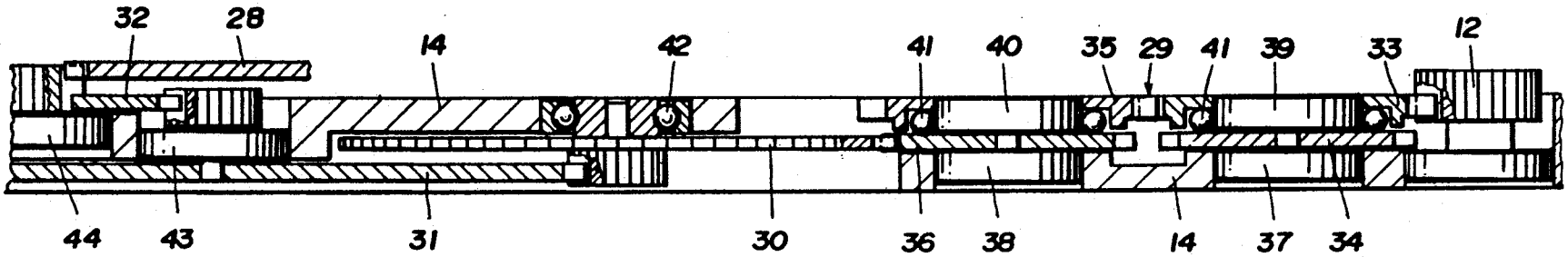
FIG. 3 is a sectional view, like FIG. 2, along line III—III of FIG. 1.

The winding gears (FIGS. 1 and 3), which connect to ratchet wheel 28 the pinion 12 meshing with toothing 6 of ring 4 of weight 2, comprise a bidirectional-input-unidirectional-output mechanism 29 of known type and three reducing gears 30, 31, 32. The mechanism 29 comprises two pairs of wheels 33, 34; 35, 36. Each pair is overhung pivoted in a roller with ball bearing 37, 38, the outer periphery of which is set with force fit into a bore of base plate 14. The upper wheels 33 and 35 have the same diameter and they mesh with one another. The lower wheels 34, 36 have also the same diameter but smaller than that of the upper wheels 33, 35. The lower wheels are idly mounted on their respective arbor, whereas the upper wheels 33 and 35 are fixed to the outer peripheries of two rollers with ball bearings 39, 40, the centers of which are fixed to the corresponding arbors.

Only the upper wheel 33 meshes with pinion 12, whereas the two lower wheels 34, 36 mesh with the wheel of the first reducing gear 30. Locking balls 41 are inserted between the two wheels of each pair of mechanisms 29. The balls 41 have as effect to solidarize the lower wheels 34, 36 to the respective upper wheels 33, 35, when the latter rotate in one direction, for instance, clockwise in FIG. 1, and to leave the lower wheels 34, 36 free, when the upper wheels rotate counterclockwise.

Thus, if pinion 12 rotates counterclockwise the wheel 33 will rotate clockwise and it will drive wheel 34. The latter will then drive the wheel of gear 30 counterclockwise. Moreover, wheel 35 will be driven by wheel 33 counterclockwise and the latter will let wheel 36 rotate freely clockwise under the driving action of the wheel of gear 30.

On the contrary, if pinion 12 rotates clockwise it will drive wheel 33 counterclockwise and the latter will in turn drive wheel 35 clockwise. Wheel 36 will then be solidarized to wheel 35 and it will drive the wheel of gear 30 counterclockwise. Wheel 33 will then let wheel 34 rotate freely clockwise under the driving action of the wheel of gear 30.

Pinion 12 and consequently weight 2 may thus rotate in either one or the other direction, gear 30 will always be driven counterclockwise by mechanism 29. The reducing gears 31 and 32 accordingly transmit all the rotations of gear 30 to the ratchet wheel 28 in the direction winding up spring 15.

Like the wheels of mechanism 29, the reducing gears 30, 31, 32 are pivoted by means of rollers with ball bearings 42, 43, 44, the outer peripheries of which are force fitted into bores of the base plate 14, the gears 30 and 32 being overhung mounted.

With the exception of the first movement gear 45, 46 which, due to the great force to which it is subjected by the barrel 16, has the ends of its arbor pivoted in two rollers with ball bearings 55, 56, the outer rolling races peripheries of which are force fitted into the base plate 14 and the upper ring 11, respectively, all the other movement gears 47, 48; 49, 23; 50; 51; 52 and 54 are pivoted in a single roller with ball bearing 57, 58, 59, 60, some being overhung mounted. This known arrangement of the movement gears has the notorious effect to reduce the thickness of the movement 1 with respect to those with gears journalled in two bearings at the ends of their arbor. The movement 1 finally comprises a minute wheel 61 mounted on the arbor 22 of the center wheel 23 and carrying a minute hand 62, as well as an hour wheel 63 journalled around the minute wheel 61 and carrying an hour hand 64. The movement 1 may have a diameter like that of a usual man's watch. It can be made with a thickness of about 3 mm.

I claim:

1. A mechanical selfwinding watch movement having a central axis and means for mounting at least an hour hand and a minute hand to turn about said central axis, a spring barrel driving the watch movement and an oscillating winding weight, said barrel and said winding weight being coaxially pivoted around said central axis of the watch movement.

2. A mechanical selfwinding watch movement according to claim 1, wherein said barrel and said winding weight have substantially the same thickness.

3. A mechanical selfwinding watch movement according to claim 2, wherein said selfwinding weight comprises a piece wholly made of heavy material, having the general shape of a sector of circular crown and wherein said barrel and said winding weight have substantially coplanar upper faces and substantially coplanar lower faces.

4. A mechanical selfwinding watch movement according to claim 1, wherein said barrel is disposed in and occupies almost the whole of a free space in said winding wheel.

5. A mechanical selfwinding watch movement according to claim 1 further comprising a circular base plate, gears pivoted in said base plate by means of ball bearings, wherein said barrel and said winding weight cover said base plate and said gears.

6. A mechanical selfwinding watch movement according to claim 5, further comprising a first crown of fixed pins, a first set of rollers constituted by ball bearings, every roller of the first set having a center fixed to one of said pins of said first crown, said winding weight being pivoted around said rollers, also comprising a second crown of fixed pins, a second set of rollers also constituted by ball bearings, every roller of the second set having a center fixed to one of said pins of said second crown, said barrel being rotatably mounted within said second set of rollers.

7. A mechanical watch movement according to claim 6, wherein every roller of said second set is located between two adjacent rollers of said first set.

8. A mechanical watch movement according to claim 6, further comprising two fixed rings having the shape of circular crowns and being superposed to said base plate, said pins having one end set in one of said rings.

9. A mechanical selfwinding watch movement according to claim 1, wherein said winding weight extends radially outwardly beyond said barrel relative to said axis and has a portion that radially outwardly overlies said barrel relative to said axis.

* * * * *